United States Patent [19]

Fantle, Jr.

[11] Patent Number: 4,883,636

[45] Date of Patent: Nov. 28, 1989

[54] BASEBALL BINGO GAME

[76] Inventor: Willard E. Fantle, Jr., 1828 - 13th St., Greeley, Colo. 80631

[21] Appl. No.: 250,511

[22] Filed: Sep. 29, 1988

[51] Int. Cl.[4] ..... A63F 3/06

[52] U.S. Cl. ..... 273/269; 273/139

[58] Field of Search ..... 273/269, 270, 277, 139

[56] References Cited

U.S. PATENT DOCUMENTS

| | | | |
|---|---|---|---|
| D. 85,735 | 12/1931 | De Leon . | |
| D. 227,281 | 6/1973 | Meyer . | |
| 1,639,894 | 8/1927 | Neuzil | 273/277 X |
| 3,495,700 | 2/1970 | Chandos | 273/269 X |
| 3,534,963 | 10/1970 | Weimer | 273/269 |
| 3,603,592 | 9/1971 | Bury | 273/240 |
| 4,169,601 | 10/1979 | Frischmann | 273/269 |
| 4,285,520 | 8/1981 | Small | 273/269 X |
| 4,469,529 | 2/1986 | Gibbs | 273/274 |

*Primary Examiner*—Anton O. Oechsle

*Attorney, Agent, or Firm*—Terry M. Gernstein

[57] ABSTRACT

A bingo-type game uses baseball plays as the key to covering various zones on a card. The plays can be offensive or defensive plays, and various patterns can be used to determine a winner. Various markers on the game card can also be used to determine the play of that game card.

15 Claims, 2 Drawing Sheets

| | 1 | 2 | 3 | 4 | 5 | 6 | 7 | 8 | 9 |
|---|---|---|---|---|---|---|---|---|---|
| 1 | HT | WLK | HIT | HO | SO | HO | SO | SO | HIT |
| 2 | SO | HIT | HO | SO | WLK | SO | WLK | HIT | HIT |
| 3 | SO | SO | HO | WLK | HIT | HIT | SO | WLK | HIT |
| 4 | HO | SO | HIT | SO | HIT | SO | SO | SO | WLK |
| 5 | SO | WLK | SO | HT | FREE | WLK | HIT | HT | SO |
| 6 | SO | SO | HT | WLK | SO | HIT | SO | SO | HO |
| 7 | HIT | SO | SO | HIT | SO | HT | HIT | SO | WLK |
| 8 | HIT | HIT | WLK | SO | WLK | HIT | SO | WLK | SO |
| 9 | HIT | WLK | SO | SO | HIT | HIT | SO | SO | WLK |

SO = STRIKE OUT
HIT = HIT
HO = HOME RUN
WLK = WALK
HT = HIT BY PITCH

30

HOME

| VISITORS \ INNING | 1 | 2 | 3 | 4 | 5 | 6 | 7 | 8 | 9 |
|---|---|---|---|---|---|---|---|---|---|
| 1 | TP | ER | PO | TP | DP | TP | SO | SO | PO |
| 2 | DP | PO | TP | SO | ER | SO | ER | PO | PO |
| 3 | SO | DP | TP | ER | PO | DP | SO | ER | PO |
| 4 | TP | SO | DP | PO | PO | SO | DP | TP | ER |
| 5 | SO | ER | SO | SO | FREE | ER | PO | TP | SO |
| 6 | SO | DP | TP | ER | TP | DP | SO | SO | TP |
| 7 | PO | SO | DP | PO | SO | TP | PO | SO | ER |
| 8 | PO | ER | SO | ER | SO | SO | SO | ER | SO |
| 9 | PO | ER | DP | SO | PO | PO | SO | DP | ER |

16SO 16ER 16PO 16DP

FIG. 3

SO = STRIKE OUT
ER = ERROR
PO = FLY OUT
DP = DOUBLE PLAY
TP = TRIPLE PLAY

FIG. 4

BASEBALL BINGO GAME

TECHNICAL FIELD OF THE INVENTION

The present invention relates to the general field of games, and to the particular field of bingo-type games. Specifically, the present invention relates to a bingo-type game that is designed to be played according to the play of a regulation baseball game.

BACKGROUND OF THE INVENTION

Sports in general has, in recent times, become a popular spectator attraction. In particular, baseball has become increasingly popular with each passing year. Therefore, more and more people see baseball games each year than the year before.

Unfortunately, however, this increased popularity is not always sustained for each team for an entire season, or in some cases, for an entire game. This is especially so if a team is out of contention for a championship, or is going through a particularly disappointing season. There may be a flagging of fan interest in such teams in such cases.

It is also to be noted that many baseball fans are accompanied to a game by someone who is not as interested in the game as they are, and may become bored during a game.

Recognizing this, many teams, and baseball teams in particular, often stage various promotional campaigns, and activities during the season and during a game. One common example of such promotional activity is the so-called "lucky fan number" printed in a program and identified by an announcer at the game during its later stages. The person having a program with the "lucky" number wins a prize, such as tickets to an upcoming game or the like. Other promotions include various door prizes, participation prizes and the like.

While most of these promotional ideas have been somewhat successful, they have fallen short of establishing and maintaining continued fan interest in a game while, at the same time, serving to increase fan knowledge of the game. Thus, for example, a young child attending his first game may not understand what a home run is and thus may not fully appreciate the occurrence of such an event and may not know enough to root for his team to hit a home run. This lack of knowledge may translate into boredom. Such a fan may be interested in a "lucky" number, but such occurrence is quite short lived and cannot maintain interest throughout the game. Certainly "lucky numbers" do little, if anything, to increase fan knowledge of the game, its rules and its nuances.

These promotional campaigns also suffer from the drawback of being quite limited in use. That is, each promotion is not amenable for use in a wide variety of situations such as use for a single game, a home stand, a month of games or even a full season of games. Thus, the rules of such games must be kept within the bounds of a quick learn and a quick use as the game probably will not be repeated. It is known that a complicated game often attracts fans and a following of its own who discuss the nuances and occurrences of that game itself. Thus, under the right set of circumstances, some fans attending a baseball game could support the baseball team while being primarily interested in the promotional game. However, at the present time, there is no such game available.

Therefore, there is need for a game which not only promotes interest in the game of baseball, but which also entertains fans for a sustained period of time while also teaching them about the game while also being adaptable to a wide variety of uses and fans in, and of, itself. A knowledgeable fan is generally the type of fan who will return to games and will support the team. Most of the common promotional games played at baseball games do not fully serve to achieve the dual end of establishing and maintaining fan interest as well as teaching fans about the game.

OBJECTS OF THE INVENTION

It is a main object of the present invention to provide a game that will establish and maintain fan interest in baseball.

It is another object of the present invention to provide a game that will teach people about the game of baseball while, at the same time, entertain them at a baseball game.

It is another object of the present invention to provide a game that is adaptable to a wide variety of promotional campaigns directed to baseball fans and potential baseball fans.

It is another object of the present invention to provide a game that is easily learned and played and is keyed to the rules and plays of baseball, yet is also amenable to being played according to complicated sets of rules.

It is a specific object of the present invention to provide a bingo-type game that is played according to the rules and plays of a baseball game.

SUMMARY OF THE INVENTION

These, and other objects, are accomplished by the game embodying the present invention which is fashioned after the rules of a bingo game, but is keyed by events occurring during the playing of a baseball game.

The game thus uses a card that is divided into a matrix having a plurality of areas, or zones, which are covered on the occurrence of a predetermined event. The game is won when a predetermined pattern of zones are covered on a particular card. The event used to determine when a zone on a card is to be covered is the occurrence of one of various plays during a baseball game. These plays can be offensive plays, defensive plays, or any other action which might occur during a baseball game.

The cards are all different in make up as in bingo, and can be used for a particular game or for a particular group of games as desired. Various patterns can be used to determine a winner. These patterns can be of a wide variety of complexity and diversity with various winning stages as desired.

For example, a simple row pattern can be declared a winner in a first stage, with a row and column pattern being a winner of another stage, and so forth until an entire card is covered for winning a final stage. The various stages can win various prizes, such as tickets, cars, season tickets and the like. The time for establishing any particular pattern can also be varied to make the game more interesting and to vary the difficulty involved in winning as desired.

There are many variations possible as well, such as allowing certain players to cover various zones without the play associated with that zone occurring and the like in order to increase interest in the game. Another example of this would be to permit the fans to cover a specified pattern of zones upon the occurrence of a rhubarb or the like in a specified inning. The limits of the game are only found in the limits of the imagination of the people running the game.

In this manner, it can be seen that many fans might be rooting for a particular play to occur in a game which play is not related to the particular game being viewed. Such a play might be needed to complete a particular level of the promotional game.

DESCRIPTION OF THE FIGURES

Other objects and advantages of this invention will become apparent from the following description taken in conjunction with the accompanying drawings wherein are set forth, by way of illustration and example, certain embodiments of this invention.

The drawings constitute a part of the present invention and illustrate various objects and features thereof.

FIG. 3 is a top plan view of a game card used in the game embodying the present invention which is keyed by defensive plays.

FIG. 4 is a table of defensive plays used to key the game card shown in FIG. 3.

DETAILED DESCRIPTION OF THE PREFERRED EMBODIMENTS

Figures 1, 2:
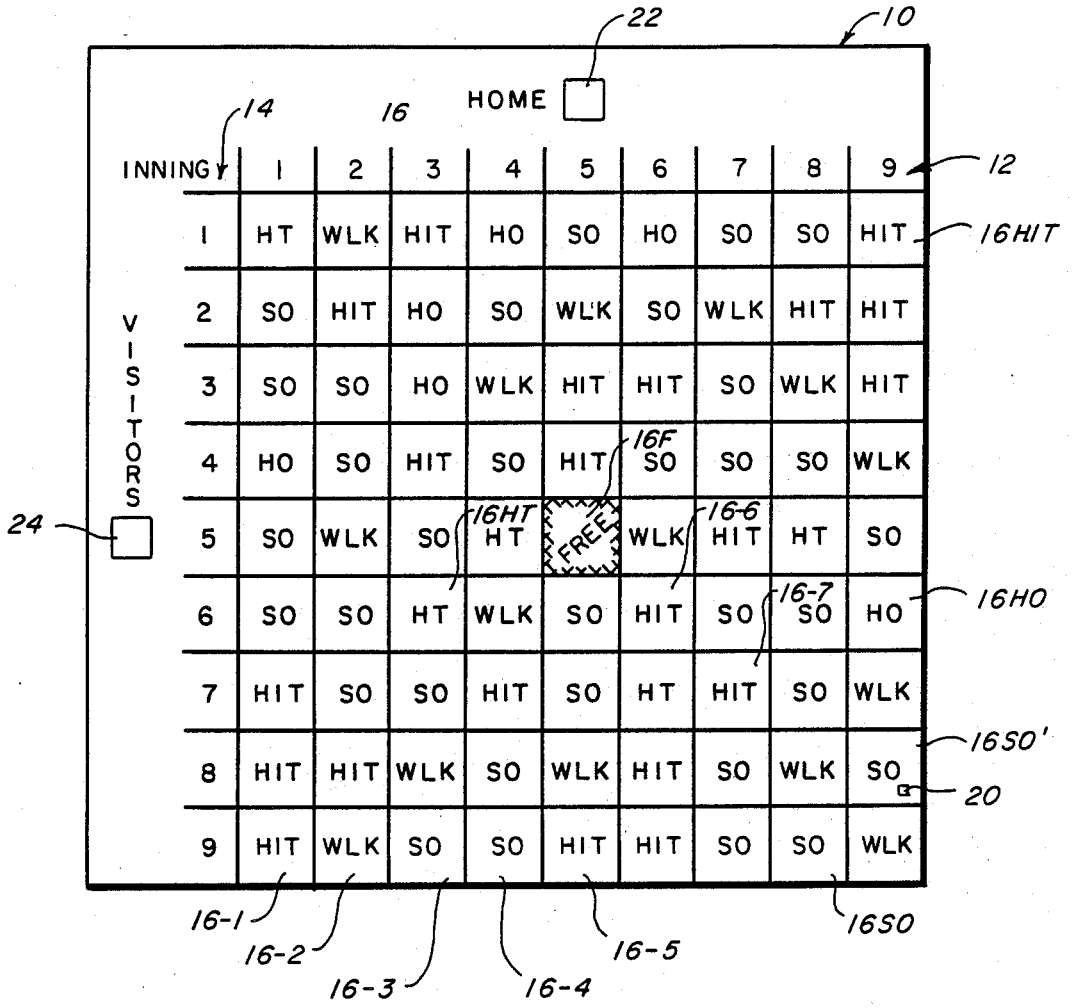
FIG. 1 is a top plan view of a game card used in the game embodying the present invention which is keyed by offensive plays.
FIG. 2 is a table of offensive plays used to key the game card shown in FIG. 1.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Shown in FIG. 1 is a game card 10 which is fashioned after a bingo game card. That is, the game card 10 includes a plurality of rows, such as row 12, and a plurality of columns, such as column 14, which are in intersecting relationship with each other to define a matrix. There are nine rows and nine columns to correspond to the nine innings of a regulation baseball game, so there is a nine-by-nine matrix forming eighty-one different zones, such as zone 16 formed at the intersection of row three and column three, and which thus corresponds to play occurring for both teams in the third inning.

As indicated in FIG. 1, the rows are associated with one team, and the columns are associated with the other team. Each zone contains indicia associated with an offensive play normally occurring during the course of a baseball game. For example, the zone designated as zone 16SO at the intersection of column eight and row nine designates a strike out of the row team in the ninth inning or a strike out of the column team in the eighth inning, the zone 16HIT at the intersection of column nine and row one designates a hit by either the row team in the first inning or a hit by the column team in the ninth inning, zone 16WLK designates a walk, zone 16HO designates a home run and zone 16HT designates a batter being hit by a pitch, and so forth. The zones are identified in the table presented in FIG. 2, and any other play can be used if desired, and these plays are intended only to illustrate the game and are not intended as being limiting. As will be discussed below, the game rules can be varied so that various zones, combinations of zones, columns and rows and combinations of zones in each row and/or column can be used for different games.

The zones are randomly distributed and positioned on each card, so that various players can cover zones during the game while other players cannot.

Since only the team at bat can score, the innings on the card correspond to the team at bat for that inning. Thus, for example, in inning number 4, if the home team suffers a strike out, that zone 16SO can be covered. Zone 16SO can also be covered if the visiting team suffers a strike out in its at bat in the bottom of the fourth inning. Thus, in one variation of the game, only that zone at the intersection of the visitor inning and the home inning is played at one time. Thus, only the zone at the intersection of column six and row six can be played for the sixth inning in such a game.

An example of an additional zone is shown in FIG. 1 as zone 16F at the intersection of row five and column 5, which is a free zone and can be covered without any corresponding play being necessary. The zone 16F can be located anywhere on the card, and is shown for inning number five only as an example.

Various markers, such as baseball bats, balls, hats, gloves and the like can be used to cover the zones, or the zones can include punchout, scratch off or erasable markers, such as indicated in zone 16SO'. The marker 20 can cover a lucky number or permit the player to cover other zones or the like to increase the interest in the game.

The game is won when a predetermined pattern of zones is covered. For example, in a game in which any play by a team permits the player to cover all zones associated with such row or column associated with the inning of such occurrence, if the zones in row nine designated by the references indicators 16-1, 16-2, 16-3, 16-4 and 16-5 are covered on one card, that card can be declared a winner. In order for this to occur in this just-mentioned game variation, the visiting team must have gotten two hits, a walk and two strike-outs in the ninth inning, or the home team must have gotten a hit in the first and fifth innings, a walk in the second inning and a strike out in the third and fourth innings.

In the first-mentioned example (where only the column and row intersection can be used) a card might be declared to be a winner when zones 16F, 16-6 and 16-7 are covered. In such a variation, the card will be a winner if the either team gets a hit in the sixth and seventh innings since the zone 16F has been declared a free zone. Other variations of the game can be devised and multiple games can be played within any single baseball game. Such variations will occur to those skilled in the art based on the teaching of the present disclosure, and such additional variations are intended to be covered by the claims appended hereto. Any bingo-type pattern of zones can be used either alone or in combination with other bingo patterns or other patterns as desired.

Various other means of playing the game can be included on the card, such as the lucky charm 22 or the hex charm 24 on the card. If these charms are of a certain color, designation, combination or the like various rules can be applied, such as covering every other zone if the charm 22 is a four leaf clover, or the like. Various negative rules can be devised as well, such as preventing the covering of corner zones, such as zone 16-1, if the hex charm is a devil, or the like. Such variations can increase the interest in a game. Various combinations of charms and markers can also be used to determine the play of the game. For example, if a lucky clover is combined with a hex devil, any green marker will win the game, and so forth.

In addition to the offensive play occurring during the game, defensive plays can be used to play the bingo game. An example of such a defensive game card is shown in FIG. 3 as card 30. The card 30 is divided in a manner similar to that of the FIG. 1 embodiment, with the zones corresponding to defensive plays as outlined in FIG. 4. Thus, zone 16SO still corresponds to a strike out, since this is a defensive play as well as an offensive play; zone 16ER corresponds to an error in play; zone 16PO corresponds to a fly-out; zone 16DP corresponds to a double play; and zone 16TP corresponds to a triple play. The rules of the game can be similar to those discussed above, and the difficulty of winning can be adjusted according to the number of the so-called "rare" plays, such as the triple play as will occur to those skilled in the art.

In some instances, the game can be adjusted to be easier to win when certain teams come to play in order to encourage fans to see the less glamourous teams. As will occur to those skilled in the art, the case might even occur that fans will be in the ball park in great numbers for a last place team, and even rooting for such last place team to make plays against the home team—which might prove to be very interesting indeed.

Charms, markers, lucky pieces and the like similar to those discussed above with regard to FIG. 1 can also be included with the defensive game card shown in FIG. 3.

It is to be understood that while certain forms of the present invention have been illustrated and described herein, it is not to be limited to the specific forms or arrangement of parts described and shown.

I claim:

1. A game card for use in combination with a baseball game, the card including:

nine rows and nine columns which intersect to form a nine-by-nine matrix having eighty-one zones, each zone being associated with a particular inning and containing indicia which corresponds to a regulation offensive play associated with a baseball game;

the card further including means for identifying the rows according to the at-bat attempts of one team participating in the baseball game, and further means for identifying the columns according to the at-bat attempts of the other team participating in the baseball game;

means for identifying when said one team executes the regulation offensive play indicated in a particular zone during its at-bat attempt in the inning associated with that particular zone; and means for identifying when the other team executes the regulation offensive play indicated in a particular zone during its at-bat attempt in the inning associated with that particular zone.

2. The card defined in claim 1 wherein said one team is the home team and said other team is the visiting team.

3. The card defined in claim 2 wherein said identifying means for said home team includes a lucky charm.

4. The card defined in claim 3 wherein said identifying means for said visiting team includes a hex charm.

5. The card identified in claim 4 wherein one of said zones is covered at the beginning of the baseball game.

6. A method of playing a game comprising:

providing a multiplicity of game cards;

dividing each game card into nine rows and nine columns which intersect to define eighty-one zones;

numbering said rows consecutively from 1 to 9;

numbering said columns consecutively from 1 to 9;

identifying said rows to correspond to one team's at-bat attempts during each inning of a baseball game;

identifying said columns to correspond to another team's at-bat attempts during each inning of the baseball game;

placing an indicator associated with a regulation offensive play occurring in the baseball game in each zone;

for each inning, covering a zone if either team carries out the offensive play designated by the indicator in such zone; and designating a card a winner when a predetermined pattern of zones are covered.

7. The method defined in claim 6 wherein said predetermined pattern includes consecutive zones in a common row.

8. The method defined in claim 6 wherein said predetermined pattern includes consecutive zones in a common column.

9. The method defined in claim 6 wherein said predetermined pattern includes zones on the corners of the matrix.

10. A game card for use in combination with a baseball game, the game card including:

nine rows and nine columns which intersect to form a nine-by-nine matrix having eighty-one zones, each zone being associated with a particular inning and containing indicia which corresponds to a regulation defensive play associated with a baseball game;

the card further including means for identifying the rows according to the defensive attempts of one team participating in the baseball game, and further means for identifying the columns according to the defensive attempts of the other team participating in the baseball game;

means for identifying when said one team executes the regulation defensive play indicated in a particular zone during its in-field attempt in the inning associated with that particular zone; and means for identifying when the other team executes the regulation defensive play indicated in a particular zone during its in-field attempt in the inning associated with that particular zone.

11. A method of playing a game comprising:

providing a multiplicity of game cards;

dividing each game card into nine rows and nine columns which intersect to define eighty-one zones;

numbering said rows consecutively from 1 to 9;

numbering said columns consecutively from 1 to 9;

identifying said rows to correspond to one team's in-field attempts during each inning of a baseball game;

identifying said columns to correspond to another team's in-field attempts during each inning of the baseball game;

placing an indicator associated with a regulation defensive play occurring in the baseball game in each zone;

for each inning, covering a zone if either team carries out the defensive play designated by the indicator in such zone; and designating a card a winner when a predetermined pattern of zones are covered.

12. The card defined in claim 1 further including a marker on at least one zone for determining further play of the card.

13. The method defined in claim 11 further including a step of uncovering a marker on a particular zone and determining a further step according to indicia under such marker.

14. The method defined in claim 11 further including using special charms on the card to determine the play of that card.

15. The method defined in claim 6 further including covering only that zone associated with the intersection of the row and column associated with a particular inning if either team executes the offensive play identified in that particular inning.

* * * * *